US009140421B2

(12) United States Patent
Yeh et al.

(10) Patent No.: US 9,140,421 B2
(45) Date of Patent: Sep. 22, 2015

(54) LIGHTING DEVICE FOR DIRECT AND INDIRECT LIGHTING

(75) Inventors: Wei-Yu Yeh, Tainan (TW); Pei-Wen Ko, Zhubei (TW)

(73) Assignee: TSMC Solid State Lighting Ltd., Hsinchu (TW)

( * ) Notice: Subject to any disclaimer, the term of this patent is extended or adjusted under 35 U.S.C. 154(b) by 263 days.

(21) Appl. No.: 13/209,258

(22) Filed: Aug. 12, 2011

(65) Prior Publication Data

US 2013/0039041 A1 Feb. 14, 2013

(51) Int. Cl.

| | |
|---|---|
| ***F21V 21/00*** | (2006.01) |
| ***F21V 29/00*** | (2006.01) |
| ***F21S 8/04*** | (2006.01) |
| ***F21V 7/00*** | (2006.01) |
| *F21Y 101/02* | (2006.01) |

(52) U.S. Cl.

CPC ..... *F21S 8/04* (2013.01); *F21V 7/0016* (2013.01); *F21V 29/20* (2013.01); *F21Y 2101/02* (2013.01); *Y10T 29/4913* (2015.01); *Y10T 29/49146* (2015.01)

(58) Field of Classification Search

CPC ..... F21S 8/04; F21V 7/0016; F21V 29/20; Y10T 29/49146; Y10T 29/4913; F21Y 2101/02

USPC ..... 362/145, 147, 404, 294, 345, 373, 362/249.02, 249.06

See application file for complete search history.

(56) References Cited

U.S. PATENT DOCUMENTS

| | | | | |
|---|---|---|---|---|
| 6,433,483 | B1 * | 8/2002 | Michael et al. | 315/76 |
| 7,766,505 | B2 * | 8/2010 | Tseng et al. | 362/217.17 |
| 2008/0266885 | A1 * | 10/2008 | Sun et al. | 362/373 |
| 2009/0002986 | A1 * | 1/2009 | Medendorp et al. | 362/247 |
| 2009/0302345 | A1 * | 12/2009 | Chuang et al. | 257/99 |
| 2011/0084593 | A1 * | 4/2011 | Chang et al. | 313/318.01 |

* cited by examiner

*Primary Examiner* — Thomas Sember

(74) *Attorney, Agent, or Firm* — Muncy, Geissler, Olds & Lowe, P.C.

(57) ABSTRACT

A lighting device includes a first heat sink having a first surface and a second surface opposite the first surface, a second heat sink having a third surface and a fourth surface opposite the third surface. The third surface of the second heat sink is bonded to the second surface of the first heat sink. The lighting device further includes a plurality of first light emitting diode (LED) modules mounted on the first surface of the first heat sink; and a plurality of second light emitting diode (LED) modules mounted on the fourth surface of the second heat sink. One or more the first LED modules generally radiates lights in a first direction. One or more the second LED modules generally radiates lights in a second direction. The first and second LED modules are covered by respective non-reflective caps. The first LED module and the second LED module are configured to be selectively turned on or off according to a predefined algorithm. The first LED modules are arranged on an outer region of the lighting device, and the second LED modules are arranged on an inner region of the lighting device. The inner region is circumferentially surrounded by the outer region.

20 Claims, 5 Drawing Sheets

LIGHTING DEVICE FOR DIRECT AND INDIRECT LIGHTING

TECHNICAL FIELD

The present disclosure relates generally to a lighting device and, more particularly, to a lighting device using light emitting diodes (LEDs).

BACKGROUND

For some lighting applications, e.g., domestic lighting, direct and indirect lighting have different purposes. For example, direct lighting is used for reading, while indirect lighting is used to provide a comfortable atmosphere. More light emitting diodes (LEDs) are used nowadays for many lighting applications, including domestic lighting. Direct lighting and indirect lighting using LEDs are provided by separate lighting devices with different layouts, which can be costly and inconvenient.

SUMMARY OF THE DISCLOSURE

A lighting device includes a first heat sink having a first surface and a second surface, and a second heat sink having a third surface and a fourth surface. The third surface is bonded to the second surface. The lighting device includes a plurality of first light emitting diode (LED) modules mounted on the first surface, and a plurality of second light emitting diode (LED) modules mounted on the fourth surface. One or more the first LED modules radiates lights in a first direction. One or more the second LED modules radiates lights in a second direction. The first and second LED modules are covered by respective non-reflective caps. The first and second LED modules are selectively turned on or off. The first LED modules are arranged on an outer region of the lighting device, and the second LED modules are arranged on an inner region of the lighting device.

BRIEF DESCRIPTION OF THE DRAWINGS

Reference is now made to the following descriptions taken in conjunction with the accompanying drawings, in which.

DETAILED DESCRIPTION

The making and using of various embodiments are discussed in detail below. It should be appreciated, however, that the present disclosure provides many applicable inventive concepts that can be embodied in a wide variety of specific contexts. The specific embodiments discussed are merely illustrative of specific ways to make and use, and do not limit the scope of the disclosure.

Figure 1A:
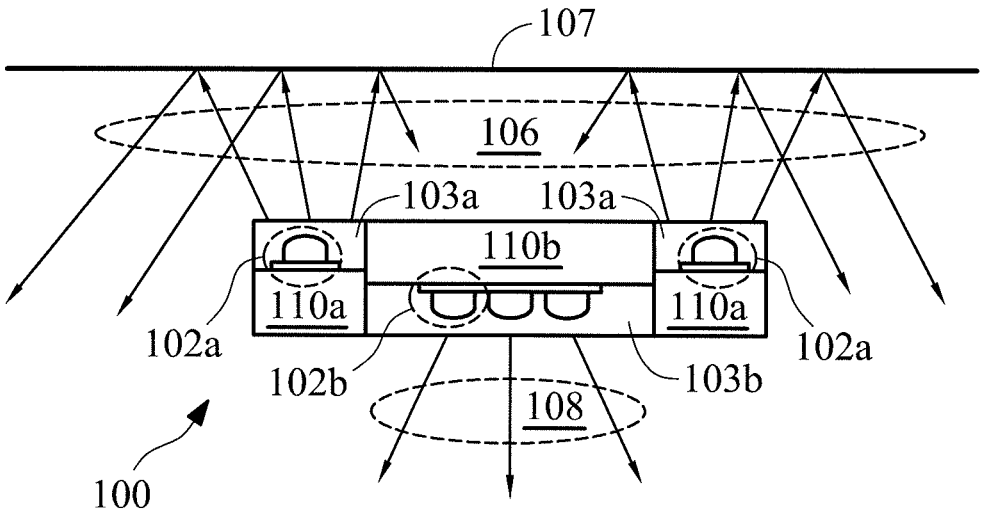
FIG. 1A is a cross-sectional view of an exemplary lighting device according to some embodiments.

FIG. 1A is a cross-sectional view of an exemplary lighting device 100 according to some embodiments. The lighting device 100 includes LED modules 102*a* and 102*b*. Some LED modules 102*a* are mounted on the heat sink 110*a* at angles such that indirect lighting 106 from reflection of lights on surfaces such as a ceiling 107 is provided by the LED modules 102*a*. Other LED modules 102*b* are mounted on the heat sink 110*b* such that direct lighting 108 is provided by the LED modules 102*b*. In general, the LED modules 102*a* and 102*b* can be mounted (e.g., on the heat sink 110*a* and 110*b*) for radiating lights generally at different directions, and not necessarily at opposite directions.

Light caps 103*a* and 103*b* are used to cover (enclose) the LED modules 102*a* and 102*b*. The light caps 103*a* and 103*b* can have arbitrary shapes and colors, which may be transparent, semitransparent, or partially transparent, etc., depending on applications. The heat sinks 110*a* and 110*b* can be one piece or multiple pieces held together (by bonding or by other mechanical means), depending on appearance and mechanical design. Good thermal management could be achieved by various arrangements of heat sinks 110*a* and 110*b* with different shapes, e.g., circular, square, rectangular, ring, band, linear, etc.

The lighting device 100 can be mechanically fixed in various ways, e.g., hung from the ceiling, mounted on a pole or stand (not shown), etc. The lighting device 100 with the LED modules 102*a* and 102*b* mounted at different directions is suited for multi-directional lighting applications. In particular, the double-sided design shown in FIG. 1A is suited for radiating light from both surfaces, e.g., for direct and indirect lighting applications. The LED modules 102*a* and 102*b* can be turned on or off with various sequential algorithms. For example, the lighting sequence can be controlled according to the following table.

TABLE 1

| Sequence | Direct | Indirect |
|---|---|---|
| 1 | On | Off |
| 2 | Off | On |
| 3 | On | On |
| 4 | Off | Off |

According to table 1, only direct lighting LED modules such as 102*b* are turned on at the first setting in the sequence, e.g., with a switch or button operation. At the second setting in the sequence, only indirect lighting LED modules such as 102*a* are turned on. At the third setting in the sequence, both are turned on, and at the fourth setting in the sequence, both are turned off. There can be many variations on the operation of the settings in the sequence. For example, there can be more settings in the sequences than just four settings as in Table 1, and the controlled units can be different (e.g., half of the direct lighting LED modules can be controlled separately from the other half of the direct lighting LED modules, etc.)

Figure 1B:
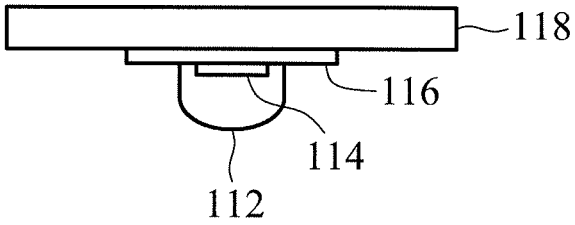
FIG. 1B is a cross-sectional view of an exemplary light emitting diode (LED) module for the lighting device in FIG. 1A according to some embodiments.

FIG. 1B is a cross-sectional view of an exemplary light emitting diode (LED) module for the lighting device in FIG. 1A according to some embodiments. An LED chip 114 is mounted on a substrate 116, which is in turn mounted on a printed circuit board (PCB) 118. An LED lens 112 encapsulates the LED chip 114. The LED chip 114 can be any color LED comprising different materials. For example, the LED chip 114 may include GaN for Blue/Green color, AlInGaP for Yellow/Red, etc. The LED chip 114 may have different sizes (e.g., dimensions of about 4×4 $mm^2$, or dimensions could be larger or smaller) with different thicknesses (e.g., about 100 μm, although the thickness could be thicker or thinner than 100 μm).

The substrate 116 could comprise silicon, ceramic, or any other suitable material. In some embodiments, a complex integrated circuit with LED or other detector circuit can be fabricated based on silicon processes. The substrate 116 can have different thicknesses, e.g., about 400 μm (but could be thicker or thinner). The substrate 116 is mounted on the PCB 118. In various embodiments, different PCBs, e.g., a PCB including FR-4, an Al-based metal core PCB (MCPCB), or Cu-based MCPCB, or any other kinds of PCB can be used. The PCB allows easier installation of the LED module and for effective thermal-conductive function.

The heat sinks 110*a* and 110*b* can comprise Al, Cu, Ag, Fe, any combination thereof, or any other suitable material. The dimension of the heat sinks 110*a* and 110*b* depends on specifications (e.g., how much power or heat, temperature requirements, etc.). For example, a 10 W LED source may need greater than 30000 $mm^2$ of heat spreading in some embodiments.

Figure 1C:
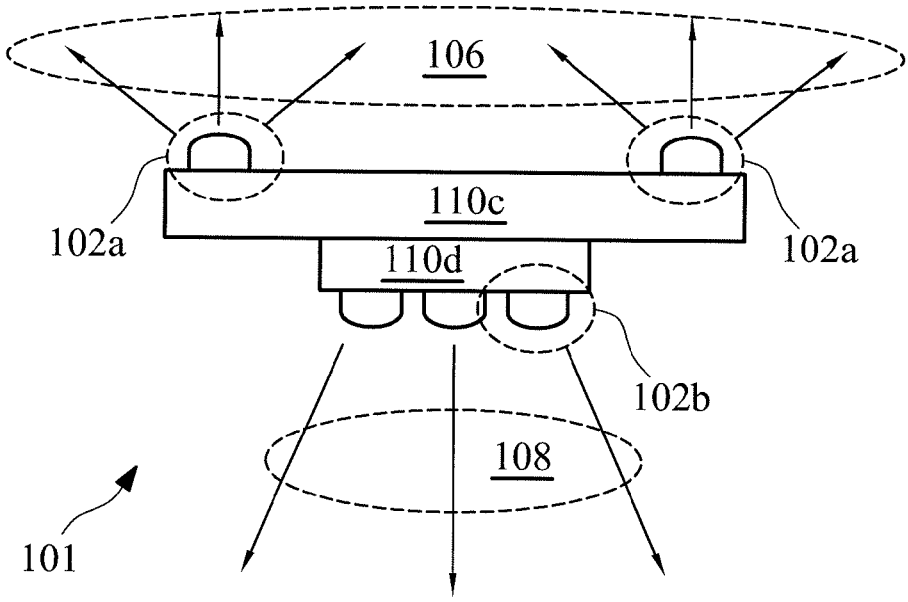
FIG. 1C is a cross-sectional view of another exemplary lighting device according to some embodiments.

FIG. 1C is a cross-sectional view of another exemplary lighting device 101 according to some embodiments. For the lighting device 101, LED modules 102*a* are mounted on a heat sink 110*c* and LED modules 102*b* are mounted on the heat sink 110*d*. The heat sinks 110*c* and 110*d* are bonded on the backside of each other, and the LED modules 102*a* and 102*b* are facing the opposite directions for different directional lighting (e.g., for direct lighting 108 and also indirect lighting 106 by reflecting on another surface, such as ceiling, which is not shown.)

Figure 2A:
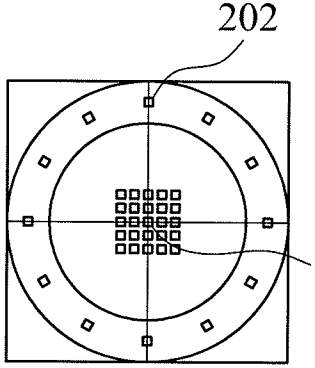
FIGS. 2A-2E are 2-dimensional views of exemplary lighting device layouts according to some embodiments.
Figure 2B:
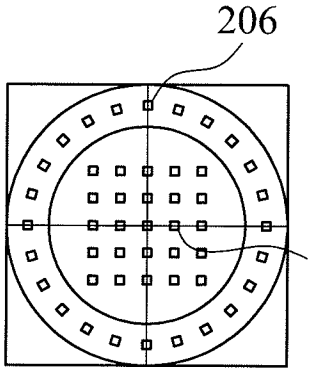

FIGS. 2A-2E are 2-dimensional views of exemplary lighting device layouts according to some embodiments. In FIG. 2A, outside LED modules 202 are arranged in a ring shape, while inside LED modules 204 are arranged in a square array concentrated in the center. The inside LED modules 204 and outside LED modules 202 are mounted on opposite sides for different lighting directions, e.g., for direct and indirect lighting. In FIG. 2B, outside LED modules 206 are also arranged in a ring shape with more numbers than FIG. 2A, while inside LED modules 208 are arranged in a square array more spread out compared to FIG. 2A.

Figure 2C:
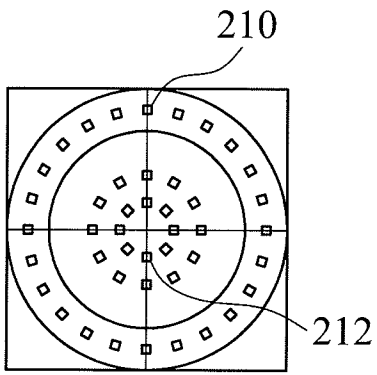
Figure 2D:
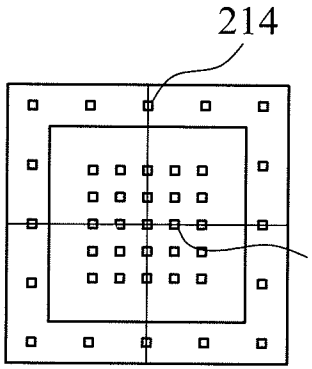
Figure 2E:
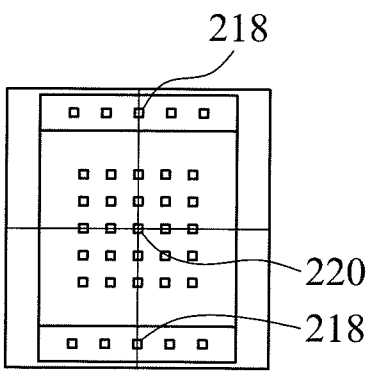

In FIG. 2C, outside LED modules 210 are also arranged in a ring shape, while inside LED modules 212 are arranged in a circular pattern. In FIG. 2D, outside LED modules 214 are arranged in a square band shape, while inside LED modules 216 are arranged in a square array. In FIG. 2E, outside LED modules 218 are arranged in a linear shape on two opposite edges, while inside LED modules 220 are arranged in a square array. The inside LED modules and outside LED modules in the examples in FIGS. 2A-2E are mounted on opposite sides for different lighting directions, e.g., for direct and indirect lighting.

The arrangement scheme can be varied and there can be different mixing of LED modules for different lighting directions, e.g., a part of inside LED modules 204 can be mounted on the same side as the outside LED modules 202 for a different lighting direction from the rest of the inside LED modules 204 (i.e., the same lighting direction as the outside LED modules 202). There can be many other variations with different shapes such as triangular, rectangular, oval, star-shape, etc. for different arrangements.

Figure 3A:
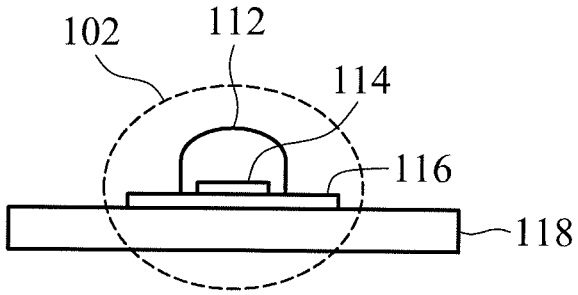
FIGS. 3A-3C are schematic diagrams at various stages of fabricating the lighting device in FIG. 1A according to some embodiments.
Figure 3B:
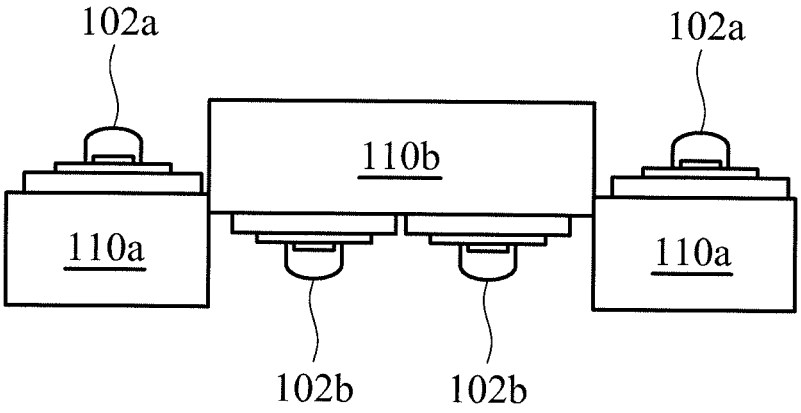
Figure 3C:
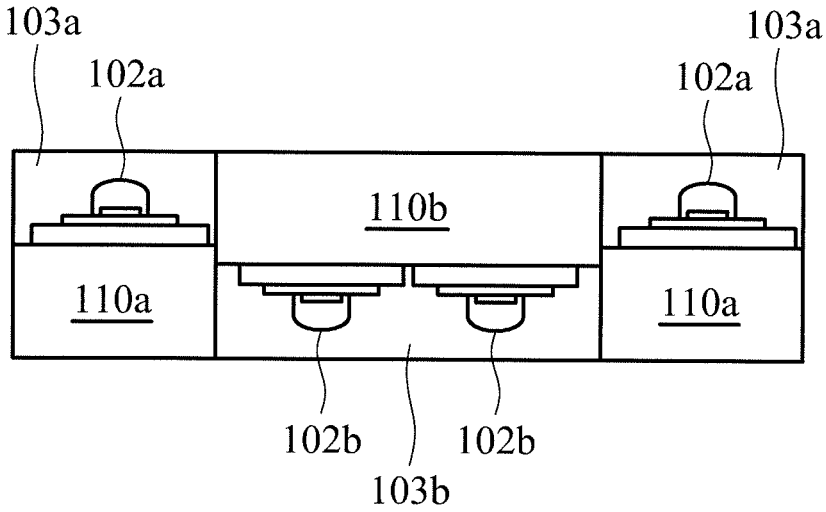

FIGS. 3A-3C are schematic diagrams at various stages of fabricating the lighting device in FIG. 1A according to some embodiments. In FIG. 3A, the LED module 102 is mounted on the PCB 118. A surface-mount technology (SMT), e.g., soldering, can be used for this step. The LED module 102 includes the LED chip 114, the substrate (sub-mount) 116, and the LED lens 112. The LED chip 114 is bonded (mounted) on the substrate 116 prior to this step, e.g., by soldering. The LED lens 112 can be formed (molded) either before or after this step.

In FIG. 3B, the LED modules 102*a* are mounted on the heat sink 110*a*, while the LED modules 102*b* are mounted on the heat sink 110*b* at different (e.g., opposite) directions. The LED modules 102*a* and 102*b* are bonded by a thermal interface layer (not shown) using heat-dissipating material with good thermal conductivity such as a thermal grease layer, a thermal pad, or any other suitable thermal interface material. The heat sinks 110*a* and 110*b* may be one piece or multiple pieces held together (by bonding or by other mechanical means), depending on the appearance and mechanical design of the lighting device.

For example, the thermal grease can be ceramic-based, metal-based, carbon based, liquid metal based, etc. Ceramic-based thermal grease is a ceramic powder suspended in a liquid or gelatinous silicone compound, which may be described as silicone paste or silicone thermal compound, e.g., beryllium oxide, aluminum nitride, aluminum oxide, zinc oxide, and silicon dioxide. Metal-based thermal grease contain solid metal particles (usually silver or aluminum). Carbon based thermal grease may contain diamond powder or short carbon fibers. A liquid metal based thermal grease contains liquid metal alloys, e.g., of gallium.

In FIG. 3C, the LED modules 102*a* and 102*b* are covered by light caps 103*a* and 103*b*, which can have arbitrary shapes and colors, and may be transparent, semitransparent, or partially transparent, etc. depending on applications. The light caps 103*a* and 103*b* can comprise plastic, glass material, or any other suitable material.

According to some embodiments, a lighting device includes at least one heat sink. At least two light emitting diode (LED) modules are mounted on the at least one heat sink. The at least two LED modules are mounted at different directions on the at least one heat sink so that a first LED module of the at least two LED modules generally radiates lights in a first direction for a direct lighting and a second LED module of the at least two LED modules generally radiates lights in a second direction for an indirect lighting by reflecting on a surface.

According to some embodiments, a method of fabricating a lighting device includes mounting at least two light emitting diode (LED) chips on substrates for forming at least two LED modules. At least two LED modules are mounted at different directions on at least one heat sink so that a first LED module of the at least two LED modules generally radiates lights in a first direction for a direct lighting and a second LED module of the at least two LED modules generally radiates lights in a second direction for an indirect lighting by reflecting on a surface.

A skilled person in the art will appreciate that there can be many embodiment variations of this disclosure. Although the embodiments and their features have been described in detail, it should be understood that various changes, substitutions and alterations can be made herein without departing from the spirit and scope of the embodiments. Moreover, the scope of the present application is not intended to be limited to the particular embodiments of the process, machine, manufacture, and composition of matter, means, methods and steps described in the specification. As one of ordinary skill in the art will readily appreciate from the disclosed embodiments, processes, machines, manufacture, compositions of matter, means, methods, or steps, that perform substantially the same function or achieve substantially the same result as the corresponding embodiments described herein may be utilized according to the present disclosure.

The above method embodiment shows exemplary steps, but they are not necessarily required to be performed in the order shown. Steps may be added, replaced, changed order, and/or eliminated as appropriate, in accordance with the spirit and scope of embodiment of the disclosure. Embodiments that combine different claims and/or different embodiments are within the scope of the disclosure and will be apparent to those skilled in the art after reviewing this disclosure.

What is claimed is:

1. A lighting device, comprising:

a first heat sink having a first surface and a second surface opposite the first surface;

a second heat sink having a third surface and a fourth surface opposite the third surface, wherein the third surface of the second heat sink is bonded to the second surface of the first heat sink;

a plurality of first light emitting diode (LED) modules mounted on the first surface of the first heat sink; and a plurality of second light emitting diode (LED) modules mounted on the fourth surface of the second heat sink;

wherein one or more the first LED modules generally radiates lights in a first direction and wherein one or more the second LED modules generally radiates lights in a second direction, wherein the first and second LED modules are covered by respective non-reflective caps; and wherein the first LED module and the second LED module are configured to be selectively turned on or off according to a predefined algorithm, wherein the first LED modules are arranged on an outer region of the lighting device, wherein the second LED modules are arranged on an inner region of the lighting device, and wherein the inner region is circumferentially surrounded by the outer region.

2. The lighting device of claim 1, wherein the algorithm includes at least the following settings:

a first setting in which the first LED modules are turned on and the second LED modules are turned off;

a second setting in which the first LED modules are turned off and the second LED modules are turned on;

a third setting in which both the first LED modules and the second LED modules are turned off; and a fourth setting in which both the first LED modules and the second LED modules are turned on.

3. The lighting device of claim 1, wherein the first direction and the second direction are opposite directions from each other.

4. The lighting device of claim 1, wherein each LED module of the first and second LED modules comprises a substrate and an LED chip mounted on the substrate.

5. The lighting device of claim 4, wherein each LED module further comprises a printed circuit board (PCB), and the substrate is mounted on the PCB.

6. The lighting device of claim 5, wherein the PCB comprises a metal core PCB.

7. The lighting device of claim 5, wherein each LED module further comprises an LED lens encapsulating the LED chip.

8. The lighting device of claim 1, wherein the non-reflective caps are semitransparent or partially transparent.

9. A method of fabricating a lighting device, comprising:

mounting a plurality of light emitting diode (LED) chips on substrates for forming a plurality of LED modules, the LED modules including a first subset of LED modules and a second subset of LED modules;

mounting the first subset of LED modules on a first surface of a first heat sink and mounting the second subset of LED modules on a fourth surface of a second heat sink, wherein a second surface of the first heat sink is bonded to a third surface of the second heat sink, so that the first subset of the LED modules generally radiates lights in a first direction on an outer region of the lighting device and the second subset of the ELD modules generally radiates lights in a second direction different from the first direction on an inner region of the lighting device, wherein the inner region is circumferentially surrounded by the outer region, and wherein the first subset of the LED modules and the second subset of the LED modules are configured to be selectively turned on or off according to a predefined algorithm; and enclosing the first and second subsets of the LED modules with respective non-reflective light caps.

10. The method of claim 9, wherein the algorithm includes at least the following settings:

a first setting in which the first subset of the LED modules is turned on and the second subset of the LED modules is turned off;

a second setting in which the first subset of the LED modules is turned off and the second subset of the LED modules is turned on;

a third setting in which both the first subset of the LED modules and the second subset of the LED modules are turned off; and a fourth setting in which both the first subset of the LED modules and the second subset of the LED modules are turned on.

11. The method of claim 9, further comprising mounting the substrates on a printed circuit boards (PCBs) and encapsulating the LED chips with LED lenses.

12. The method of claim 9, wherein the LED modules are mounted on the first or second heat sinks by applying a thermal grease material.

13. The method of claim 9, wherein the first direction and the second direction are opposite directions from each other.

14. A lighting device, comprising:

a first heat sink having a first surface and a second surface opposite the first surface;

a second heat sink having a third surface and a fourth surface opposite the third surface, wherein the second surface of the first heat sink is bonded to the third surface of the second heat sink;

a plurality of light emitting diode (LED) modules mounted on the first and second heat sinks, the LED modules including a first subset and a second subset of LED modules, wherein the first subset of LED modules is disposed on the first surface of the first heat sink in an inner region of the lighting device, while the second subset of LED modules is disposed on the fourth surface of the second heat sink and in an outer region of the lighting device that circumferentially surrounds the inner region; and one or more first non-reflective light caps that cover the first subset of LED modules and one or more second non-reflective light caps that cover the second subset of LED modules;

wherein the first subset of LED modules generally radiates lights in a first direction and the second subset of LED modules generally radiates lights in a second direction opposite to the first direction, and wherein the first subset of LED modules and the second subset of LED modules are configured to be independently switched on or off according to a series of predefined states that include the following:

a first state in which the first subset of LED modules is switched on and the second subset of LED modules is switched off;

a second state in which the first subset of LED modules is switched off and the second subset of LED modules is switched on;

a third state in which both the first subset of LED modules and the second subset of LED modules are switched off; and a fourth state in which both the first subset of LED modules and the second subset of LED modules are switched on.

15. The lighting device of claim 14, wherein the LED modules each include a substrate and an LED chip mounted on the substrate.

16. The lighting device of claim 15, wherein the LED modules each include a print circuit board (PCB), wherein the substrate is mounted on the PCB.

17. The lighting device of claim 15, wherein the PCB includes a metal core PCB.

18. The lighting device of claim 16, wherein a thermal grease material bonds the PCB and at least one of the first heat sink and the second heat sink.

19. The lighting device of claim 15, wherein each LED module further includes an LED lens encapsulating the LED chip.

20. The lighting device of claim 14, wherein the first and second non-reflective light caps are semitransparent or partially transparent.

* * * * *